United States Patent [19]

Lucas

[11] Patent Number: 5,018,549

[45] Date of Patent: May 28, 1991

[54] PUMP COLUMN

[75] Inventor: Jan H. Lucas, Delft, Netherlands

[73] Assignee: Shell Internationale Research Maatschappij B.V., The Hague, Netherlands

[21] Appl. No.: 71,455

[22] Filed: Jul. 9, 1987

[30] Foreign Application Priority Data

Aug. 5, 1986 [NL] Netherlands ..... 8601994

[51] Int. Cl.[5] ..... B67D 5/00

[52] U.S. Cl. ..... 137/355.23; 137/355.2; 248/80; 239/197; 222/530

[58] Field of Search ..... 248/65, 75, 76, 80, 248/89; 222/530, 538; 137/355.16, 355.2, 355.23; 239/197, 195

[56] References Cited

U.S. PATENT DOCUMENTS

| | | | |
|---|---|---|---|
| 2,242,749 | 5/1941 | Hope | 222/530 |
| 2,516,728 | 7/1950 | Smith | 222/538 X |
| 2,595,655 | 5/1952 | Hannay | 137/355.2 X |
| 2,872,142 | 2/1959 | Pottash | 248/80 |
| 2,896,659 | 7/1959 | Erickson | 137/355.23 X |
| 3,819,137 | 6/1974 | Smith | 248/80 X |
| 4,005,942 | 2/1977 | Gilb | 248/903 |
| 4,131,218 | 12/1978 | Tatsuno | 137/355.16 X |
| 4,416,396 | 11/1983 | Ward | 222/530 X |
| 4,650,100 | 3/1987 | Echazabal, Jr. | 222/530 X |

FOREIGN PATENT DOCUMENTS

| | | | |
|---|---|---|---|
| 103944 | 8/1926 | Austria | 222/530 |
| 1125462 | 8/1968 | United Kingdom | 222/530 |

*Primary Examiner*—Ramon O. Ramirez
*Assistant Examiner*—Robert A. Olson
*Attorney, Agent, or Firm*—Jones, Tullar & Cooper

[57] ABSTRACT

A fuel delivery pump column for a fuel filling station provided with at least one filling gun or nozzle and one filling hose and structure for varying the pivot point or point of suspension of the filling hose.

13 Claims, 2 Drawing Sheets

PUMP COLUMN

The invention relates to a pump column with at least one filling gun or nozzle and one filling hose. Such pump columns are used for dispensing fuels at a fuel filling station. At such stations, (generally known) pump islands are present, the base of which is formed by the pump housing. This contains a plurality (for example 4) of fuel pumps, vents and volumeters. These pumps are driven by suitable means, such as an electric motor.

The fuel is supplied via a plurality of suction lines which, after the pumps, run as pressure pipes up into a column which in practice accommodates a plurality of flexible filling hoses which terminate in filling guns or nozzles. Located at a suitable height (for example about 1 meter) on the column are holders for the filling guns. Such arrangements in a filling station are known and will not be described in detail.

Hose handling with such known arrangements, however, requires a considerable amount of force and a lot of movement. The pivot point or suspension point of the hose (i.e. the point at which the hose "leaves" the column) is fixed, and, after the filling gun has been removed from the holder, if the hose is too short to be introduced into the mouth of the tank to be filled, the hose has to be extended against a permanent spring tension that tends to roll it up.

Furthermore, it is possible with the known arrangement for the filling hoses to lie partly on the ground, with the danger that motorists may drive over them.

It is therefore an object of the present invention to overcome these disadvantages and to provide an arrangement whereby, during refuelling, the filling hose runs more or less tautly (not along the ground) from the pump column to the mouth of the fuel tank to be filled without any effort by the user, and, after the filling gun has been returned to its holder, the filling hose can easily be stored (zipped) in a hose storage space from the top of the column.

The invention therefore relates to a pump column provided with at least one filling gun or nozzle and one filling hose, characterized in that the pivot point or suspension point (i.e. the point at which the hose "leaves" the column) of the filling hose is mobile.

In this way, there is no tension during refuelling, apart from the weight of the hose, and the hose cannot drag over the ground unless the user drops the filling gun. Furthermore, the length of the hose is used efficiently due to the movement of the suspension point or pivot point.

Because of the height of the suspension point or pivot point, the weight of the hose does not need to be supported.

Neither is there a counterweight that needs to be supported.

Moreover, a compact storage of the filling hoses is possible.

The invention will now be explained by way of example in more detail with reference to the accompanying drawings, in which:

FIG. 2(*b*) is a horizontal sectional view of the mechanism of FIG. 2(*a*).

Figure 1:
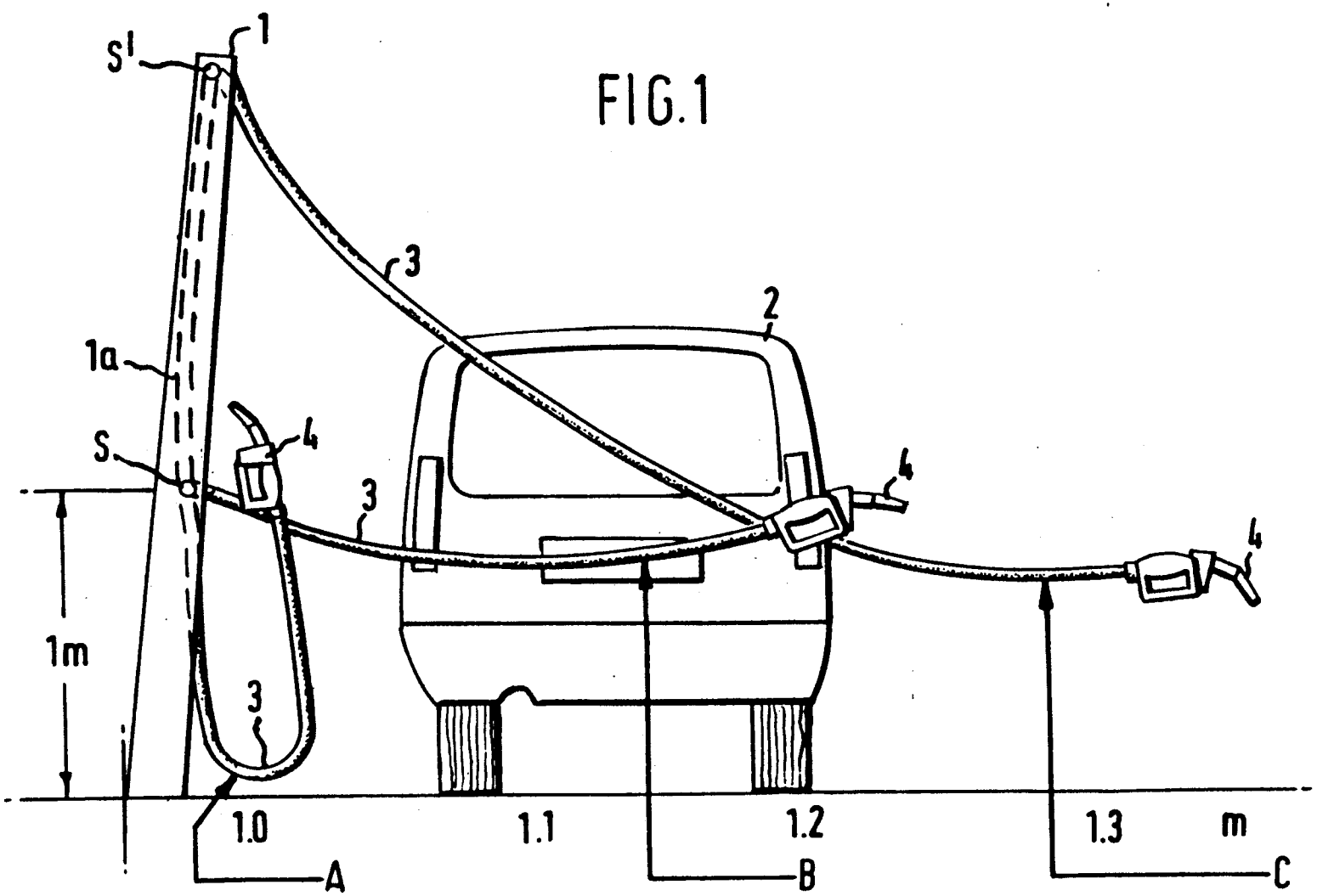
FIG. 1 is a view of the situation at a pump island.

Referring to FIG. 1, a pump column 1 of a pump island and also a vehicle 2 (rear view) are shown.

The pump column 1 is provided with a number of filling hoses 3 and filling guns or nozzles 4. (There are 3 hoses and 3 filling guns drawn in various positions in FIG. 1.) The filling hoses are suspended in any suitable manner almost vertically from a column of, for example, 2.50 meters high, the pivot point or suspension point S of the hose being mobile. The major portion (drawn as a dashed line) of the hose can be stored in the hose storage space 1*a*. In position A (stationary position), the filling gun 4 is hung at a height of about 1 meter in a suitable holder (not drawn for the sake of clarity). In order to refuel, a user removes the filling gun 4 from the holder and introduces it into the mouth of the tank to be filled.

If the vehicle has the mouth of the tank to be filled on the pump side, the free length of the hose (generally about 2 meters) is quite sufficient to reach the mouth and enable comfortable refuelling. This is shown by the situation B (max. reach of the hose 3 from the hose pivot point S).

If, however, the filler cap is on the other side of the vehicle 2, the filling hose can, according to the invention, easily be pulled further out of the storage space (for example about 1.5 meters extra).

This is because the filling hose 3 is hung loosely in the storage space 1*a* in a hose storage means that will be described non-restrictively below with reference to FIG. 2*a, b*. In an advantageous, non-restrictive embodiment of the invention, this hose storage means functions as a gripping means. By pulling the filling gun 4, the hose 3 is pulled through the gripping means and the desired extra length (for example about 1.5 meters) is released. The gripping point (=suspension point or pivot point) of the hose 3 thus moves up the column 1 as more of the hose's length is released. (See situation C (maximum reach with highest position S1 of the pivot point or suspension point of the hose.) This prevents the hose 3 from hanging over the ground (unless the filling gun is dropped) and also provides a favourable weight distribution.

As the hose is gripped in the storage means, there is only tension on the whole system while the hose is being withdrawn. Once the desired length has been attained, the tension disappears (apart from the weight).

After refuelling, the filling gun 4 is replaced in its holder. This triggers a hose retaining mechanism, described below, at the top of the column, which can take place in any suitable manner. The hose retention mechanism can, for example, consist of a wheel or roller member.

This wheel or roller member moves downwards and pushes (zips) the hose 3 back into the storage means until the original pivot point or suspension point is reached.

The wheel or roller member then moves up again. The hose 3 is now again stored in the column (stationary position A).

Figure 2A:
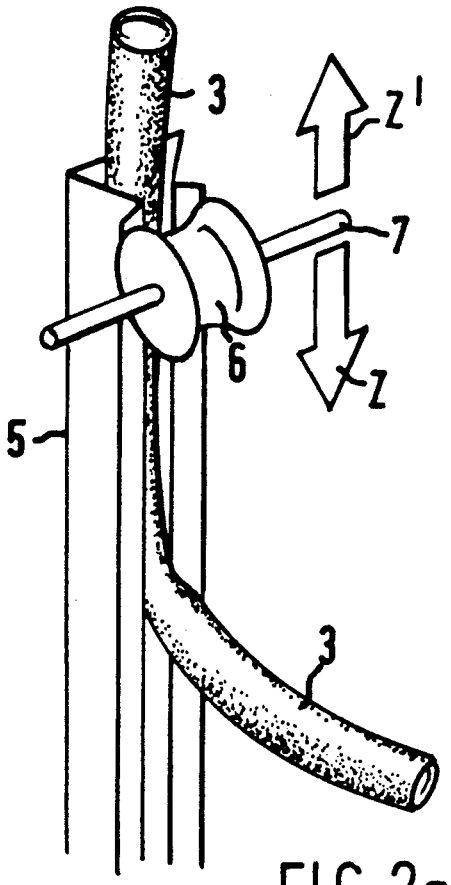
FIG. 2(*a*) is a longitudinal view of a hose retaining and storage mechanism, which mechanism is used in the arrangement of the invention.

Referring now to FIGS. 2*a, b*, the hose storage means and hose retention means located in the hose storage space 1*a* of the column 1 are shown more clearly.

FIG. 2*a* is a longitudinal view of an advantageous embodiment of a hose storage means 5, as is shown located in the hose storage space la of the pump column 1 drawn in FIG. 1 and in which the filling hose 3 can be gripped.

Figure 2B:
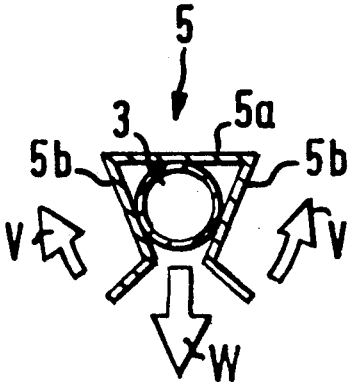

FIG. 2*b* is a horizontal sectional view of the storage means 5 and the gripped filling hose 3. The storage means 5 can, for example, comprise a length of profile section (5*a*, 5*b*) of any suitable material, the side walls 5*b* of which can move resiliently outwards (arrows V in FIG. 2*b*), so that the filling hose 3 can be pulled outwards (arrow W in FIG. 2*b*) at the open side of the section (i.e. the side of the pump column facing the filling gun).

As indicated above, the suspension point (pivot point) of the filling hose is higher the further the mouth of the tank to be filled is from the pump island. The wheel or roller member 6 is provided with an axle 7 (FIG. 2*a*) and is used to push (zip) the filling hose 3 back down into the storage means 5 after use. This is done, after withdrawal of the filling hose 3, by moving the wheel or roller member 6 downwards (arrow Z in FIG. 2*a*) along the open side of the storage means 5 until the filling hose has reached its "stationary" pivot point or suspension point S (see FIG. 1).

The wheel or roller member 6 then moves back up along the storage means 5 (arrow Z' in FIG. 2*a*) and can again be actuated for a subsequent hose operation. As has already been mentioned above, the actuation of the hose retaining mechanism, such as the wheel or roller member 6, can be performed in any suitable manner (for example electronically, mechanically, etc.) and this will not be described in detail. The wheel or roller member can, for example, be moved in an upward and downward direction along the storage means 5 by any suitable drive, e.g. a chain. For the sake of clarity, neither the attachment of the storage means 5 in the column nor that of the wheel or roller member 6 is shown.

It is pointed out that the front of the storage means 5 (the "open" side through which the hose 3 is pulled out) can be closed by flexible members of any suitable material, for example rubber flaps or brushes. It is further pointed out that the hose storage means need not necessarily consist of a section with resilient side walls. A section with non-resilient side walls, provided with a resilient/hinged front can also be employed.

In an advantageous embodiment of the invention, it is also possible for the filling hose to be formed such that it can be gripped in the hose storage space of the column. To this end, the filling hose can be provided with protruberances such as ribs, etc. In that case, the section of the hose storage space does not need to be resilient.

It will be clear that the invention is not limited to pump columns at filling stations for road vehicles, but can be employed for all suitable fluid containers, in which the hose operation has to satisfy the above-described requirements. An example could be the filling of jerrycans.

Various modifications of the present invention will become apparent to those skilled in the art from the foregoing description. Such modifications are intended to fall within the scope of the appended claims.

I claim:

1. A pump column for a fuel filling station, comprising: at least one filling nozzle and one filling hose; at least one filling hose storage space, in which the hose is loosely suspended virtually vertically from the pump column and from which it can be pulled out in such a manner that a pivot point of the hose, at which the hose leaves the column virtually vertically moves up the pump column as more of the hose length is released; and a hose retaining mechanism which, refueling after in actuated at the top of the pump column, pushes the released part of the filling hose back into the hose storage space as it virtually vertically moves downwards until the original pivot point of the hose is reached and which then virtually vertically moves up again.

2. The pump column as claimed in claim 1, wherein the filling hose is formed such that it can be gripped in the filling hose storage space.

3. The pump column as claimed in claim 2, wherein the filling hose is provided with protruberances or ribs.

4. The pump column as claimed in claim 1, wherein the filling hose storage space comprises means consisting of a length of profile section with an open side on the side of the pump column facing the filling nozzle.

5. The pump column as claimed in claim 4, wherein the profile section is provided with resilient side walls.

6. The pump column as claimed in claim 4, wherein the profile section is provided with a resilient/hinged front.

7. The pump column as claimed in any one of claims 1-3, wherein the hose retaining mechanism comprises a wheel or roller member that is mobile along the hose storage space.

8. The pump column as claimed in any one of claims 4-19, wherein the hose retaining mechanism comprises a wheel or roller member that is mobile along the hose storage space.

9. The pump column as claimed in claim 8, wherein the wheel or roller member is mobile along the filling hose storage space at its open side.

10. The pump column as claimed in any one of claims 4-19, wherein the filling hose storage space is closed by flexible members.

11. The pump column as claimed in claim 10, wherein the flexible members are rubber flaps or brushes.

12. A pump column for a fuel filling station, comprising: at least one filling nozzle and one filling hose; at least one filling hose storage space, in which the hose is loosely suspended and from which it can be pulled out in such a manner that a pivot point of the hose, at which the hose leaves the column, moves up the pump column as more of the hose length is released; and a hose retaining mechanism which, after refuelling, pushes the released part of the filling hose back into the hose storage space as it moves downwards until the original pivot point of the hose is reached, said retaining mechanism comprising a wheel or roller member that is mobile along the hose storage space.

13. The pump column as claimed in claim 12, wherein the filling hose storage space comprises means consisting of a length of profile section with an open side on the side of the pump column facing the filling nozzle, and wherein the wheel or roller member is mobile along the filling hose storage space at its open side.

* * * * *